US006955378B2

(12) United States Patent
Schlack et al.

(10) Patent No.: US 6,955,378 B2
(45) Date of Patent: Oct. 18, 2005

(54) LATCH ASSEMBLY

(75) Inventors: Richard E. Schlack, Rising Sun, MD (US); Robert H. Bisbing, Kennett Square, PA (US)

(73) Assignee: Southco, Inc., Concordville, PA (US)

( * ) Notice: Subject to any disclaimer, the term of this patent is extended or adjusted under 35 U.S.C. 154(b) by 0 days.

(21) Appl. No.: 10/136,764

(22) Filed: Apr. 30, 2002

(65) Prior Publication Data

US 2002/0163201 A1 Nov. 7, 2002

Related U.S. Application Data

(60) Provisional application No. 60/287,630, filed on Apr. 30, 2001.

(51) Int. Cl.[7] ..... E05C 7/00
(52) U.S. Cl. ..... 292/26; 292/232
(58) Field of Search ..... 292/26, 47, 97, 292/98, 195–197, 111, 124, 132, 215, 224, 292/234, 27, 46, 222, 232, 113, 123

(56) References Cited

U.S. PATENT DOCUMENTS 1,070,365 A * 8/1913 Voight
1,117,643 A * 11/1914 Dommer ..... 292/46
2,789,851 A * 4/1957 Lickteig ..... 292/98
3,041,097 A * 6/1962 Eads ..... 292/113
3,325,200 A * 6/1967 Fowler ..... 292/113
3,706,467 A * 12/1972 Martin ..... 292/111
4,127,016 A * 11/1978 Ibsen ..... 70/92
4,417,430 A * 11/1983 Loikitz ..... 52/582.2
4,880,261 A 11/1989 Bisbing
5,064,228 A 11/1991 Bisbing
5,333,920 A * 8/1994 De Rover ..... 292/48
5,452,925 A * 9/1995 Huang ..... 292/57
5,452,927 A * 9/1995 Uyeda ..... 292/202
5,551,793 A * 9/1996 Lewis ..... 403/322

OTHER PUBLICATIONS

Southco Handbook 2000, English Edition, (Southco, Inc., Concordville, Pennsylvania) pp. 138-143.

* cited by examiner

*Primary Examiner*—Gary Estremsky
(74) *Attorney, Agent, or Firm*—Paul & Paul

(57) ABSTRACT

The latch assembly includes a housing, a crank member disposed within the housing for limited rotational movement therein, a pawl, a crank pin, and an attachment pin. The latch assembly may further comprise an actuating member or system, such as a rod. The pawl is selectively movable between latched and unlatched positions in response to rotational movement of the crank member. The crank member is in operable engagement with the actuating member or system, whereby upon rotation of the actuating member, the crank member or pawl is pivoted and slid between latched and unlatched positions.

12 Claims, 16 Drawing Sheets

LATCH ASSEMBLY

CROSS-REFERENCE TO RELATED APPLICATIONS

This application claims the benefit of the priority of U.S. Provisional Application for Patent Ser. No. 60/287,630, filed on Apr. 30, 2001.

BACKGROUND OF THE INVENTION

This invention relates to the field of latching mechanisms, and more particularly to the field of latching assemblies. This latching assembly, in a particular embodiment, may be described as a remote latching assembly, as the term is used herein, is a latching assembly in which the latching action of the assembly occurs at a location remote from the latch actuator part of the assembly.

Many types of remote latching mechanisms are known and used in the art. One of the most common types is the garage door mechanism located inside the garage door, wherein a centrally located latch actuator assembly, which usually consists of a handle protruding from the outside of the door and connected by an axle to the mechanism on the inside of the door, is connected in an offset fashion to one end of a pair of latching bars with each bar traversing the inside of the garage door horizontally and in opposite directions. The other end of each of the latching bars terminates just short of the inside edge of the respective sides of the garage door, where it is usually retained in a keeper, when the latching mechanism is in an open position.

To latch the mechanism, the handle is rotated which causes the latching bars or rods to extend laterally into a detent or cutout provided on a frame which usually is located on the inside of the garage wall and next to each of the respective sides of the garage door.

SUMMARY OF THE INVENTION

The present invention is directed towards a latching assembly which provides a high degree of precision and security, whether used as a compression type remote latching mechanism or, alternatively, used as a non-compression type remote latching system. The remote latching assembly is particularly suited for use in securing closure members to a frame, such as cabinets or like structures.

The latch assembly comprises a housing, a crank member disposed within the housing for limited rotational movement therein, a pawl, a crank pin, and an attachment pin. The latch assembly may further comprise an actuating member or system, such as a rod. The pawl is selectively movable between latched and unlatched positions in response to rotational movement of the crank member. The housing may be affixed to the inside of the door. The crank member is in operable engagement with the actuating member or system, whereby upon rotation of the actuating member, the crank member or pawl is pivoted and slid between latched and unlatched positions. The crank pin, forming the operative connection between the crank member and the pawl, helps to provide positive latching action.

It is a feature of the present invention that the latch assembly is actuated through the rotation of the actuating member about its longitudinal axis.

Accordingly, it is an object of the present invention to provide a latching assembly that can be used as either a compression or non-compression remote latching assembly.

It is a further object of the present invention to provide a latching assembly having positive over-center latching action.

It is yet another object of the invention to provide a latching assembly which is economical to manufacture and easy to install.

It is a further object of this invention to provide a secure latching assembly which has an aesthetically pleasing appearance when viewed from the outside.

These and other objects of the invention will become apparent to one skilled in the art upon a further reading of the specification, including the detailed description of the embodiments with reference to the drawings and the appended claims.

DETAILED DESCRIPTION OF THE PREFERRED EMBODIMENTS

Figure 1:
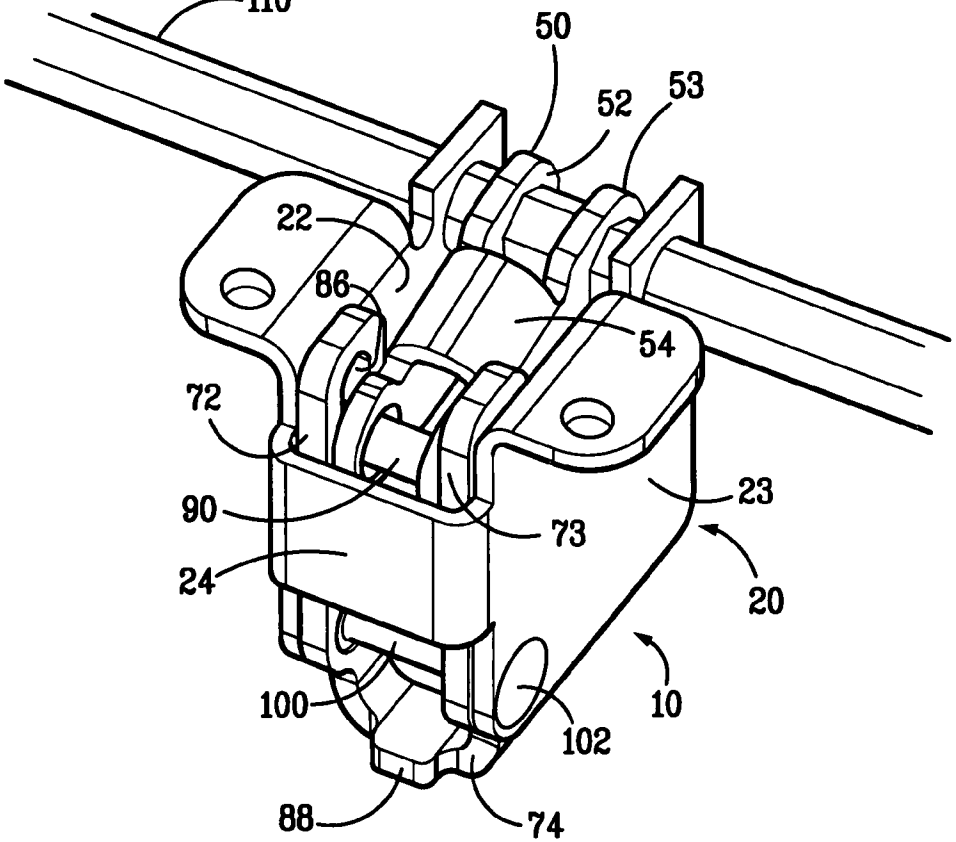
FIG. 1 is a front perspective view of a latch assembly in an unlatched position.
Figure 2:
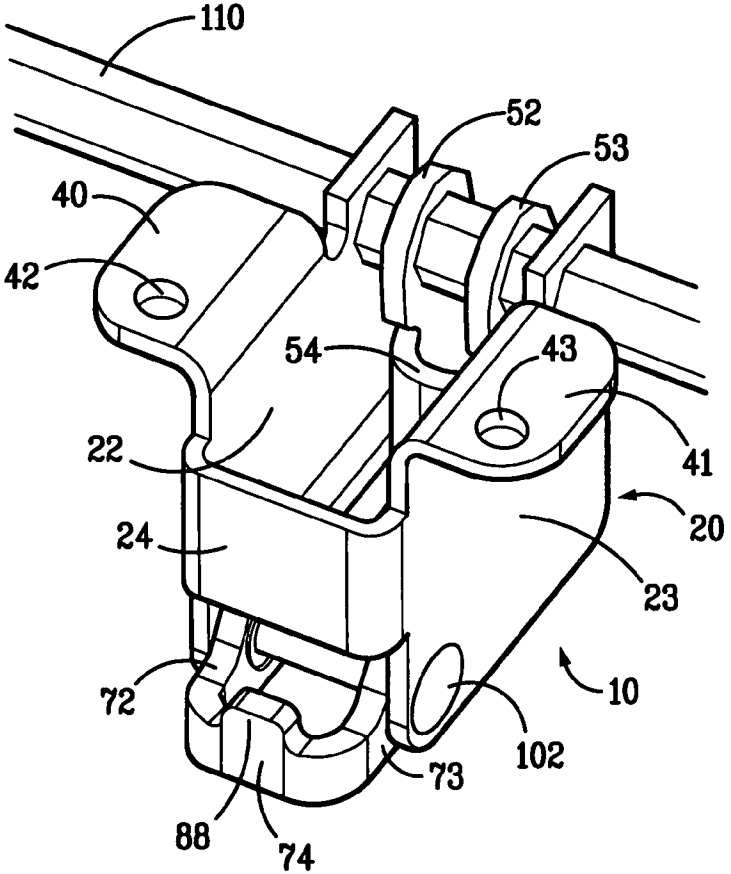
FIG. 2 is a front perspective view of the latch assembly of FIG. 1, in a latched position.

The present invention is a latch assembly 10 wherein latching and unlatching are controlled by rotational movement of a crank member 50 of the latch assembly 10. Referring to FIGS. 1–24, the latch assembly 10 comprises a housing 20, the crank member 50, a pawl 70, a crank pin 90, and a pawl pivot pin 100. The latch assembly 10 may further comprise a means for actuating the crank member.

The housing 20, as illustrated in FIGS. 1–8, has spaced-apart side walls 22, 23, a front wall 24 extending between the side walls 22, 23, an open rear end 26, an open top 28, and an open bottom 30. Each side wall 22, 23, preferably substantially parallel and opposite to one another, has a first aperture 32, 33 located about the upper portion of the front end 34 and adapted for receiving the pawl pivot pin 100, and a second aperture 36, 37 located about the lower portion of the rear end 26 and adapted for receiving the means for actuating the crank member. The first aperture 32, 33 of each side wall 22, 23 serves as the pivot point for the pawl 70. It is preferred that the front wall 24 is positioned about the lower and middle portions of the front end 34 of the housing 20 and that the top 28 is open so that a sufficient clearance is provided for the front end 76 of the pawl 70 to unobstructively pivot and rotate between the unlatched and latched positions. The front wall 24 provides increased structural integrity to the housing 20. It is obvious to one in the art that any combination of the rear end 26, top 28, and bottom 30 of the housing 20, can be partially or completely closed. The lower edges 38, 39 of the side walls 22, 23 turn outwardly to form mounting flanges 40, 41 whereby each mounting flange 40, 41 has a mounting aperture 42, 43 for facilitating mounting of the housing 20 to the inside surface 14 of the first panel, frame, or door 12 by screws or any other fastening means (not shown) known in the art. It is obvious to one in the art that the mounting apertures 42, 43 and fastening means can be reversibly positioned on the first panel, frame, or door 12 and mounting flanges 40, 41, respectively, and that the mounting apertures 42, 43 and fastening means can be of any number and shape.

The crank member 50, as illustrated in FIGS. 9–12, has spaced-apart bars 52, 53, a cross-piece 54 extending between the bars 52, 53 at the bottom 56, an open front end 58, an open rear end 60, and an open top 62. Each bar 52, 53, preferably substantially parallel and opposite to one another, of the crank member 50 has a first aperture 64, 65 located about the front portion of the bar 52, 53 and adapted for receiving the crank pin 90, and a second aperture 66, 67 located about the rear portion of the bar 52, 53 and adapted for receiving the means for actuating the crank member. It is preferred that the second apertures 66, 67 of the bars 52, 53 of the crank member 50 are of hexagonal shape, but it is obvious to one in the art that the second apertures 66, 67 can be of any desired shaped. The cross-piece 54 provides increased structural integrity to the crank member 50, and is preferably positioned about the middle portion of the bottom 56 of the crank member 50. It is obvious to one in the art that any combination of the bottom 50, front end 58, rear end 60, and top 62 of the crank member 50 can be partially or completely closed.

The pawl 70, as illustrated in FIGS. 1–4 and 13–16, has spaced-apart bars 72, 73, a front extension 74 extending between the bars 72, 73 at the front end 76, an open rear end 78, an open top 80, and an open bottom 82. Each bar 72, 73, preferably substantially parallel and opposite to one another, of the pawl 70 has a first aperture 84, 85 located about the front portion and adapted for receiving the pawl pivot pin 100, and a slotted aperture 86, 87 adapted for receiving a corresponding end of the crank pin 90. Each slotted aperture 86, 87 extends from about the middle portion of the bar 72, 73 toward the rear portion of the bar 72, 73, and allows the corresponding end of the crank pin 90 to move and slide translationally within the slotted aperture 86, 87 when the means for actuating the crank member actuates and rotates the crank member 50. The front extension 74 provides increased structural integrity to the pawl 70, and has a catch 88 extending downwardly from the bottom edge 75 of the front extension 74 such that the catch 88 helps to bring or grab the second panel, frame, or door 16 toward the first panel, frame, or door 12 when the pawl 70 is pivoted and rotated from the unlatched position to the latched position. The pawl 70 is self-locking, or over center. A result of this self-locking and security feature is that the latch assembly 10 remains in the latched position when an additional force, such as the force generated by a person trying to pry the first and second panels, frames, or doors 12, 16 apart, is applied to the pawl 70 via the second panel, frame, or door 16. The latch assembly 10 cannot be placed in the unlatched position from the latched position without the crank member 50 being actuated by the means for actuating the crank member. It is preferred that each of the rear end 78, top 80, and bottom 82 of the pawl 70 is mostly or completely open so that a sufficient clearance is provided for the rear end 78 of the pawl 70 and front end 58 of the crank member 50 to unobstructively rotate between the unlatched and latched positions.

The crank pin 90 has a first end 92, a second end 94, and a longitudinal body 96 extending between the first and second ends 92, 94. The crank pin 90 is adapted for being secured to the crank member 50 such that the first end 92 of the crank pin 90 extends a predetermined distance perpendicularly away from the first aperture 64, 65 of one of the bars 52, 53 of the crank member 50, the second end 94 of the crank pin 90 extends a predetermined distance perpendicularly away from the first aperture 64, 65 of the other bar 52, 53 of the crank member 50, and the longitudinal body 96 of the crank pin 90 is positioned generally perpendicular to the longitudinal axis of the crank member 50 and between the bars 52, 53 of the crank member 50.

The pawl pivot pin 100 has a head 102, a free end 104, and a longitudinal body 106 extending between the head 102 and free end 104. The pawl pivot pin 100 is adapted for pivotally securing the pawl 70 with the housing 20 such that the head 102 is positioned proximate the first aperture 32, 33 of one of the side walls 22, 23, the free end 104 of the pawl pivot pin 100 is positioned proximate the first aperture 32, 33 of the other side wall 22, 23, and the longitudinal body 106 of the pawl pivot pin 100 is positioned generally perpendicular to the longitudinal axis of the pawl 70 and between the bars 72, 73 of the pawl 70. It is preferred that the diameter of the head 102 is greater than the diameter of the corresponding first aperture 32, 33 of one of the side walls 22, 23 so that the head 102 will pivotally secure the pawl 70 with the housing 20 at one of the two ends. The pawl 70 and housing 20 can be pivotally secured to one another by any means known in the art, such as spreading the free end 104 of the pawl pivot pin 100 in making the diameter of the spread free end 104 greater than the diameter of the corresponding first aperture 32, 33 of the other side wall 22, 23 so that the spread free end 104 will pivotally secure the pawl 70 with the housing 20 at the other end.

The means for actuating the crank member, such as a rod 110, is rotatably moveable about a longitudinal axis thereof. Some examples of the means for actuating the crank member are a rod 110, a knob member, a rod connected to an actuating system having a handle adapted for rotatably moving the rod 110, and any other actuating means known in the art. The means for actuating the crank member, such as a rod 110, is adapted for being positioned through the second apertures 36, 37 of the side walls 22, 23 of the housing 20 and the corresponding second apertures 66, 67 of the bars 52, 53 of the crank member 50. Since the second apertures 66, 67 of the bars 52, 53 of the crank member 50 are preferably of hexagonal shape, it is preferred that the rod 110, knob member, and the like are also of hexagonal shape, but it is noted that the rod 110, knob member, and the like can be of any desired shape without departing from the spirit and scope of the present invention. From the description above it is readily apparent that the rod 110 engages the crank member 50 such that the crank member 50 rotates with the rod 110 about the longitudinal axis of the rod 110 as the rod 110 is rotated.

It is preferred that each of the housing 20, crank member 50, pawl 70, crank pin 90, and pawl pivot pin 100 is made of one-piece construction and a material such as metal, metal alloy, or stainless steel.

Figure 3:
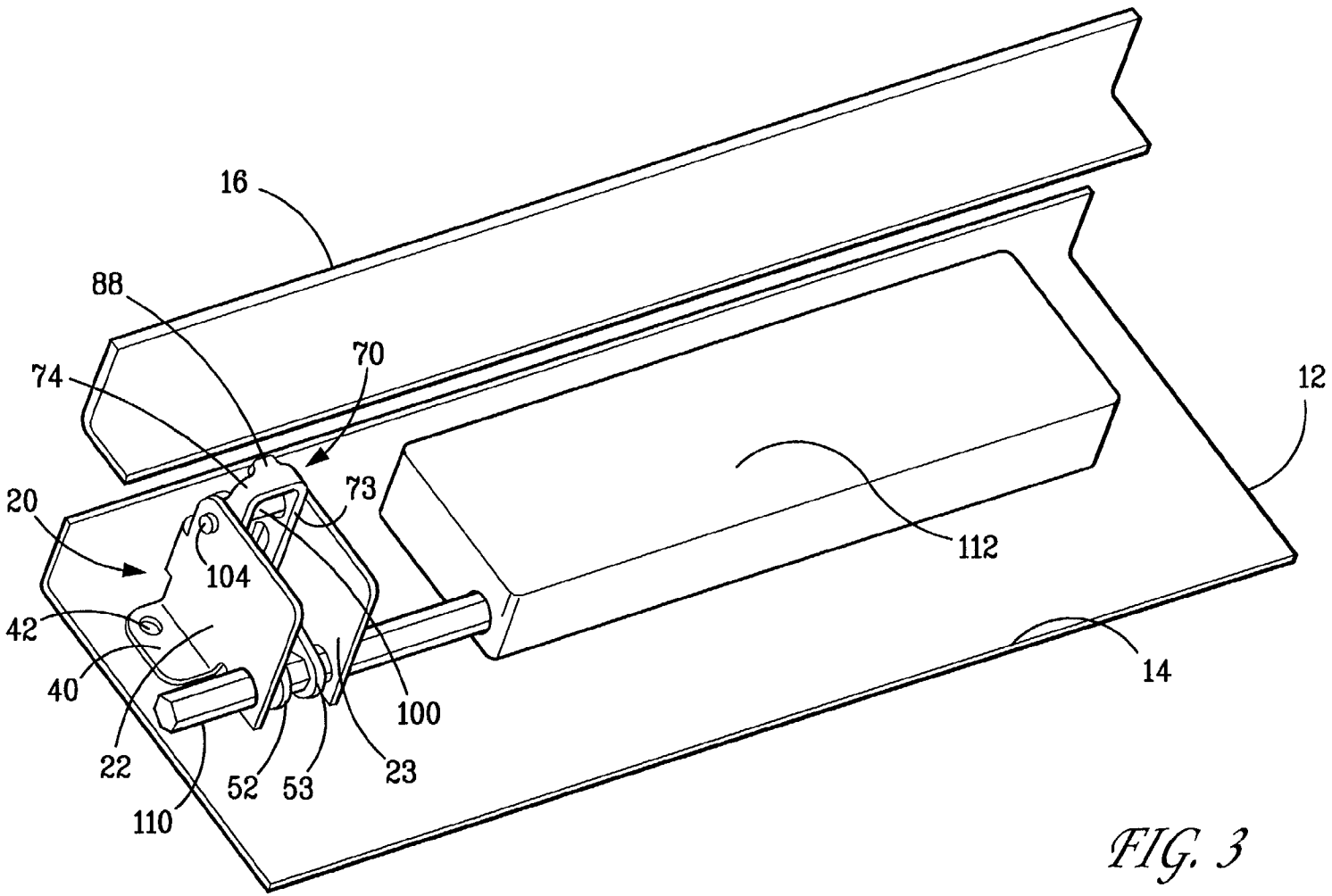
FIG. 3 is a rear environmental view of the latch assembly of FIG. 1, as applied to a first panel or the like, in the unlatched position.

When assembled, as illustrated in FIGS. 1–4, most of the elements or parts of the latch assembly 10 are positioned within or proximate the housing 20. In the assembled unlatched position as shown in FIG. 3, the crank pin 90 is secured to the crank member 50 such that the first and second ends 92, 94 of the crank pin 90 are positioned within the corresponding slotted apertures 86, 87 of the bars 72, 73 of the pawl 70 about the rear end 78 of the pawl 70. Also, the pawl 70 is pivotally secured to the side walls 22, 23 of the housing 20 by the pawl pivot pin 100 such that the pawl pivot pin 100 passes through the first apertures 84, 85 of the bars 72, 73 of the pawl 70 and the corresponding first apertures 32, 33 of the side walls 22, 23 of the housing 20. Additionally, the crank member 50 and pawl 70 are in a generally perpendicular position to one another. Further, the rod 110 is positioned through the second apertures 36, 37 of the side walls 22, 23 of the housing 20 and the corresponding second apertures 66, 67 of the bars 52, 53 of the crank member 50. After assembly, the latch assembly 10 can be mounted to the inside surface 14 of the first panel, frame, or door 12 via the mounting apertures 42, 43 of the mounting flanges 40, 41 of the housing 20 by screws or any other fastening means (not shown) known in the art.

In use, the assembled and mounted latch assembly 10 can be placed in the unlatched and latched positions by the means for actuating the crank member. To place the assembled and mounted latch assembly 10 in the latched position from the unlatched position (as shown in FIG. 3), the rod 110 is actuated to rotate in the direction away from the front end 34 and toward the rear end 26 of the housing 20 so that the crank member 50 is caused to rotate in the same general direction as the direction of rotation of the rod 110. The rotation of the crank member 50 causes the first and second ends 92, 94 of the crank pin 90 to move and slide upwardly within the slotted apertures 86, 87 of the bars 72, 73 of the pawl 70. The upward moving and sliding of the ends 92, 94 of the crank pin 90 within the slotted apertures 86, 87 causes the front portion of the pawl 70 to pivot and rotate downwardly about the pivot point toward the first panel, frame, or door 12 when the ends 92, 94 of the crank pin 90 approach the front portion and make contact with the upper, inside edges of the slotted apertures 86, 87. From that point, the latch assembly 10 can then be placed in the fully latched position (as shown in FIG. 4) by continuing the rotation of the rod 110 till the ends 92, 94 of the crank pin 90 reach the rear portion of the slotted apertures 86, 87 such that the longitudinal axis of the pawl 70 is generally parallel to the longitudinal axis of the first panel, frame, or door 12 and generally perpendicular to the axis of the crank member 50.

Figure 4:
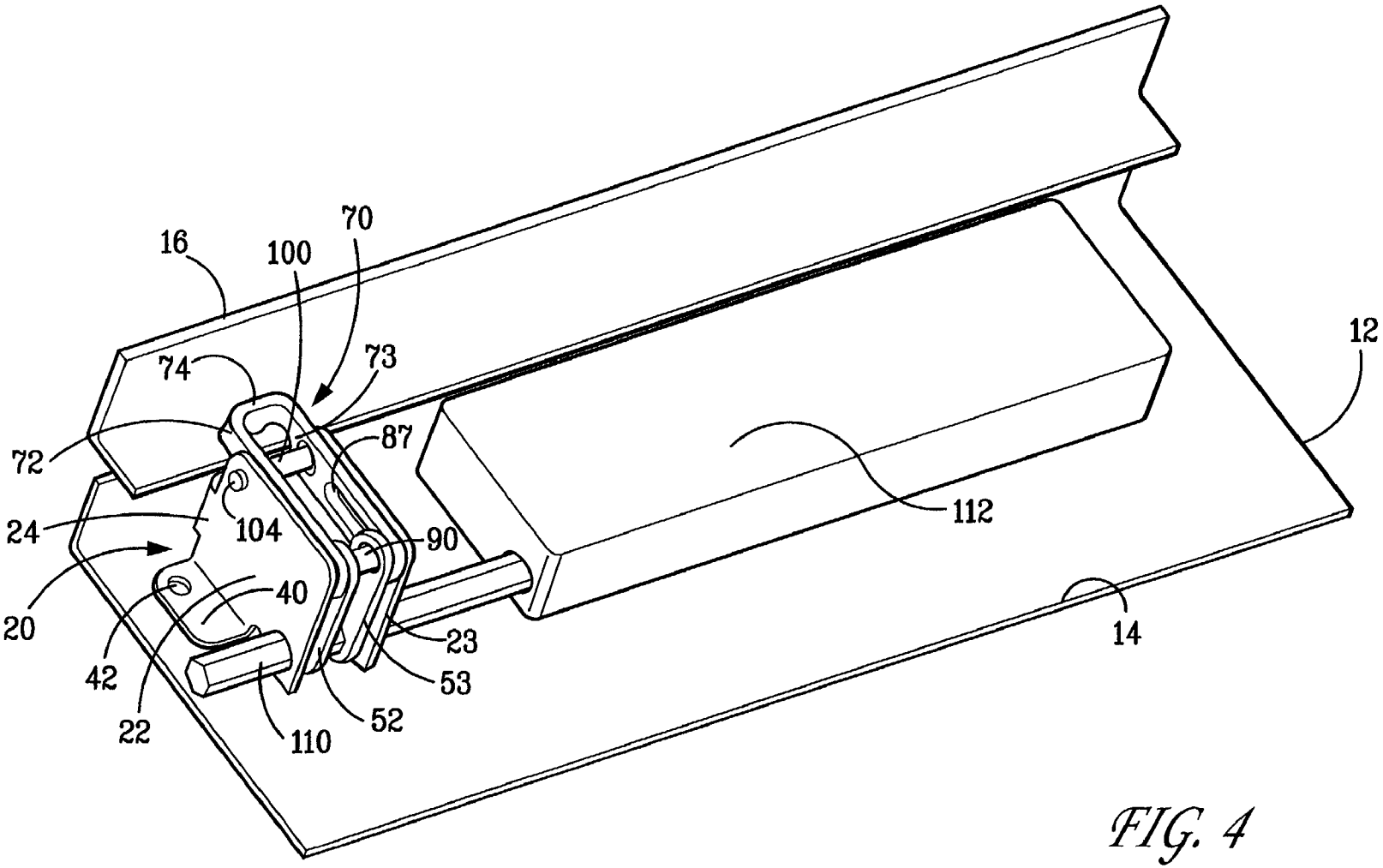
FIG. 4 is a rear environmental view of the latch assembly of FIG. 1, as applied to a first panel or the like, in the latched position.
Figure 6:
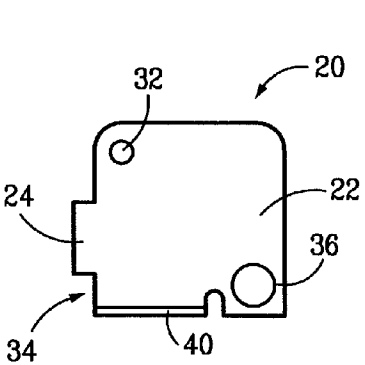
FIG. 6 is a side view of the housing of FIG. 5.
Figure 8:
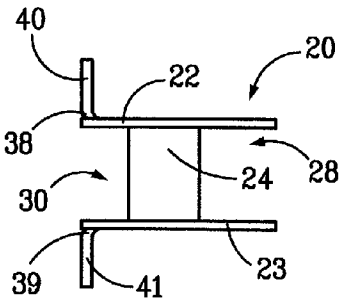
FIG. 8 is a rear view of the housing of FIG. 5.
Figure 5:
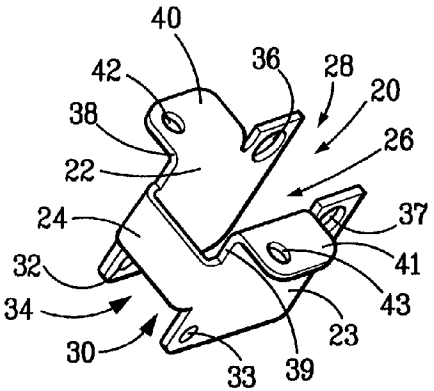
FIG. 5 is a front perspective view of a housing of the latch assembly of FIG. 1.
Figure 7:
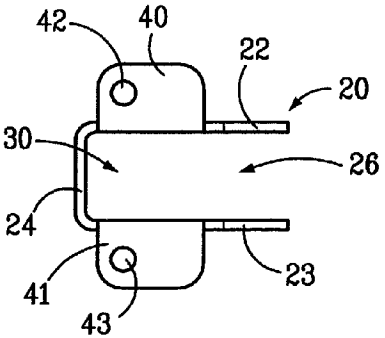
FIG. 7 is a bottom view of the housing of FIG. 5.
Figure 10:
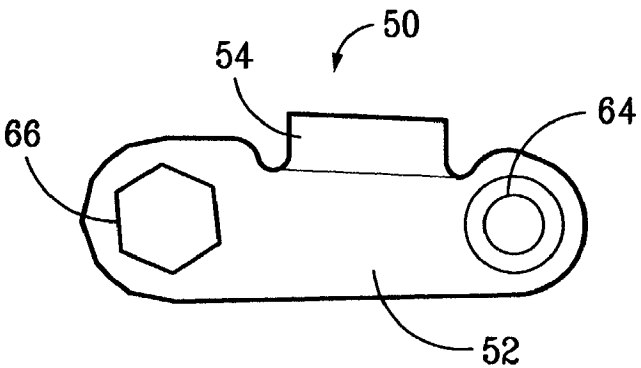
FIG. 10 is a side view of the crank member of FIG. 9.
Figure 12:
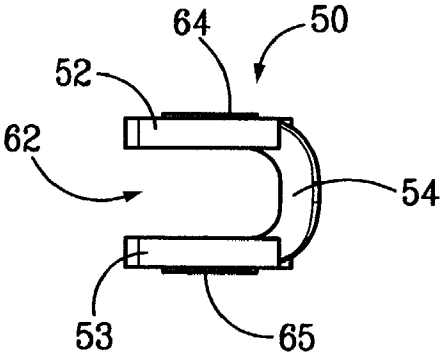
FIG. 12 is a rear view of the crank member of FIG. 9.
Figure 9:
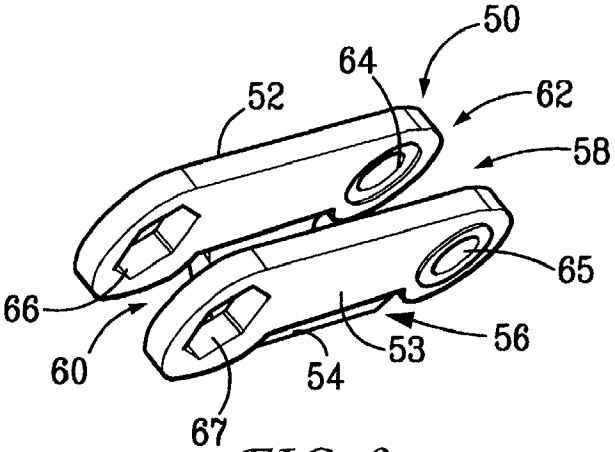
FIG. 9 is a top perspective view of a crank member of the latch assembly of FIG. 1.
Figure 11:
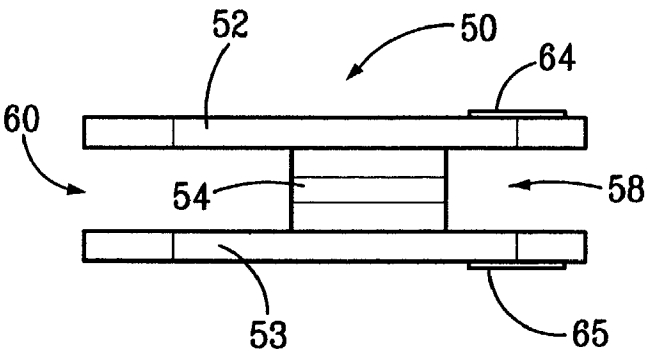
FIG. 11 is a bottom view of the crank member of FIG. 9.
Figure 14:
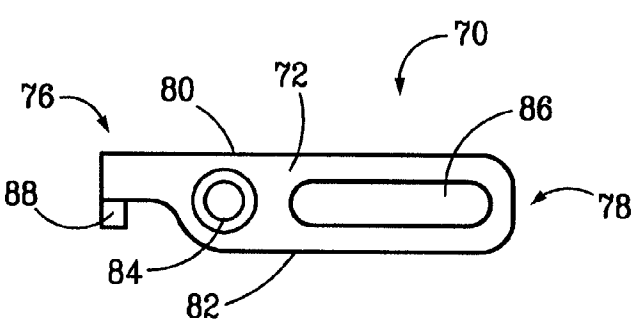
FIG. 14 is a side view of the pawl of FIG. 13.
Figure 16:
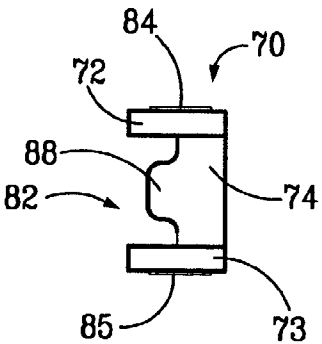
FIG. 16 is a rear view of the pawl of FIG. 13.
Figure 13:
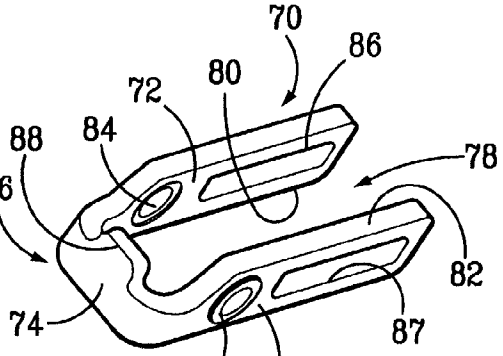
FIG. 13 is a perspective view of a pawl of the latch assembly of FIG. 1.
Figure 15:
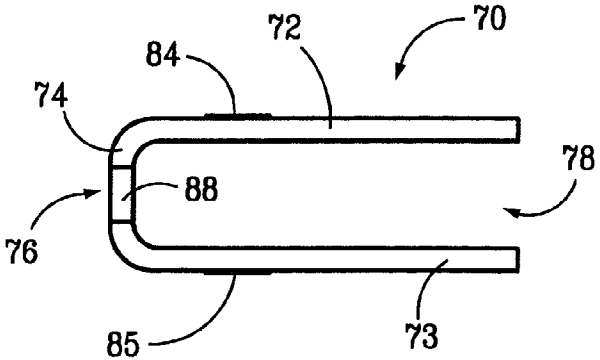
FIG. 15 is a bottom view of the pawl of FIG. 13.
Figure 18:
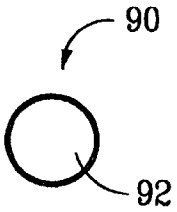
FIG. 18 is a side view of the crank pin of FIG. 17.
Figure 20:
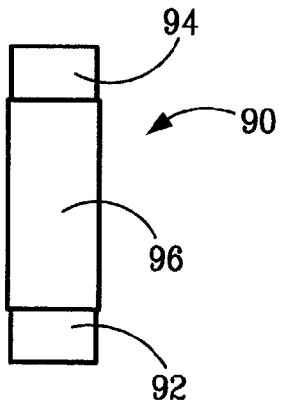
FIG. 20 is a bottom view of the crank pin of FIG. 17.
Figure 17:
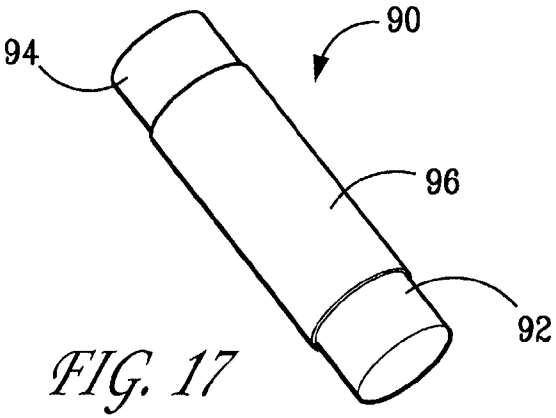
FIG. 17 is a perspective view of a crank pin of the latch assembly of FIG. 1.
Figure 19:
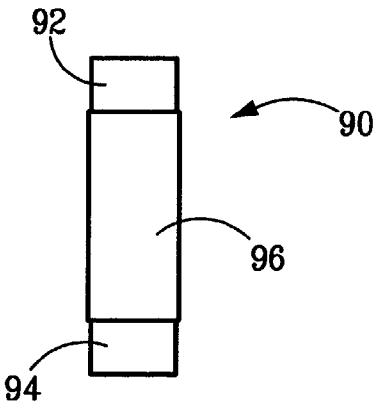
FIG. 19 is a rear view of the crank pin of FIG. 17.
Figure 22:
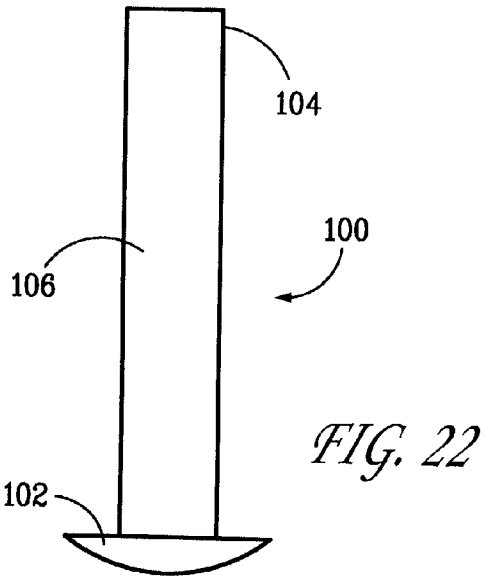
FIG. 22 is a right side view of the pawl pivot pin of FIG. 21.
Figure 24:
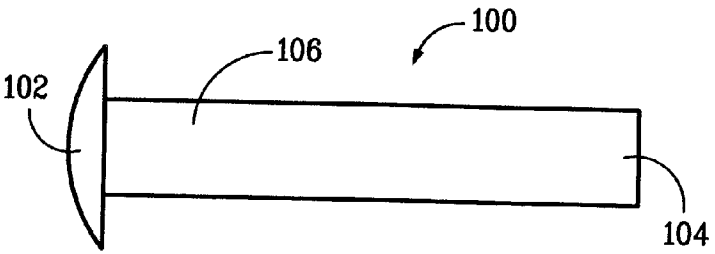
FIG. 24 is a left side view of the pawl pivot pin of FIG. 21.
Figure 21:
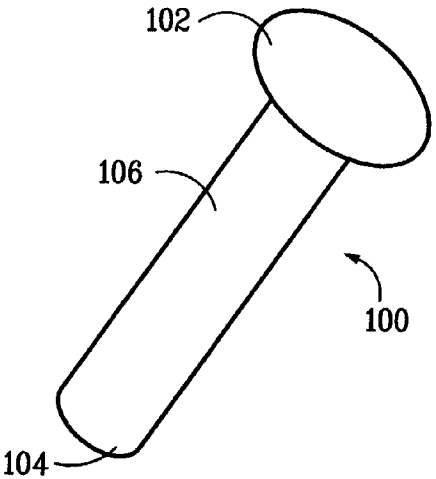
FIG. 21 is a perspective view of a pawl pivot pin of the latch assembly of FIG. 1.
Figure 23:
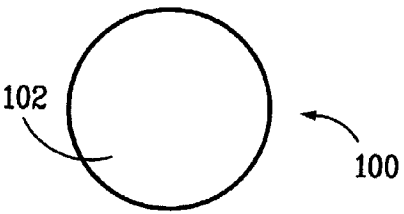
FIG. 23 is a top view of the pawl pivot pin of FIG. 21.
Figure 25:
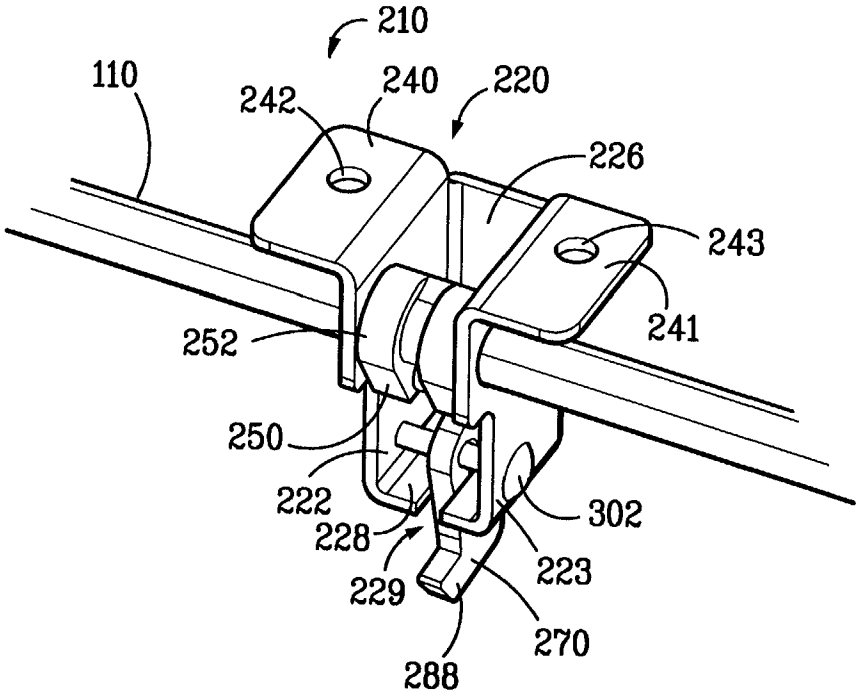
FIG. 25 is a front perspective view of a latch assembly of an alternate embodiment in an unlatched position.
Figure 26:
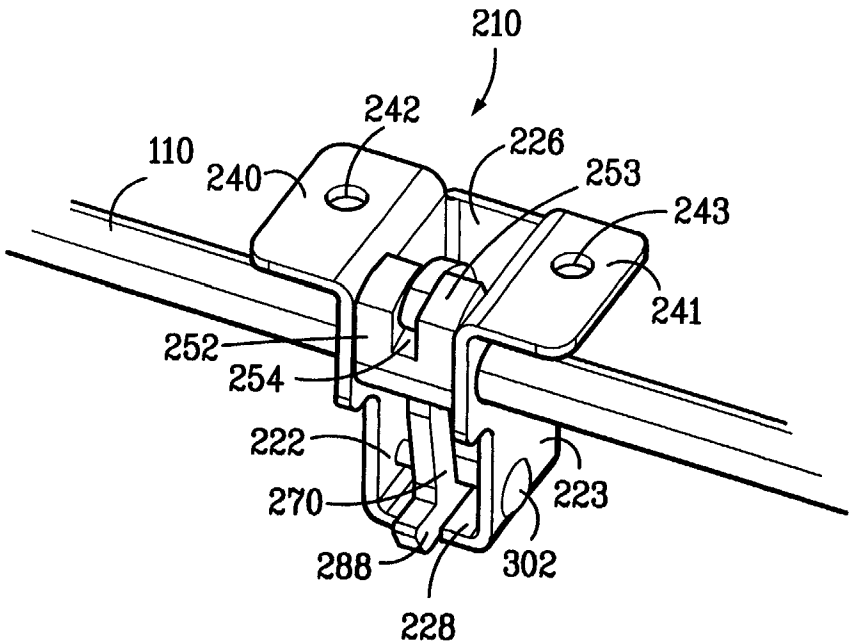
FIG. 26 is a front perspective view of the latch assembly of FIG. 25, in a latched position.

To place the assembled and mounted latch assembly 10 in the unlatched position from the latched position (as shown in FIG. 4), the rod 110 is actuated to rotate in the direction toward the front end 34 and away from the rear end 26 of the housing 20 so that the crank member 50 is caused to rotate in the same general direction as the direction of rotation of the rod 110. The rotation of the crank member 50 causes the first and second ends 92, 94 of the crank pin 90 to move and slide, initially toward the front portion of the slotted apertures 86, 87 of the bars 72, 73 of the pawl 70 and then downwardly, within the slotted apertures 86, 87. The downward moving and sliding of the ends 92, 94 of the crank pin 90 within the slotted apertures 86, 87 causes the front portion of the pawl 70 to pivot and rotate upwardly about the pivot point away from the first panel, frame, or door 12 when the ends 92, 94 of the crank pin 90 approach the front portion and make contact with the lower, inside edges of the slotted apertures 86, 87. From that point, the latch assembly 10 can then be placed in the fully unlatched position (as shown in FIG. 3) by continuing the rotation of the rod 110 till the ends 92, 94 of the crank pin 90 reach the rear portion of the slotted apertures 86, 87 such that the longitudinal axis of the pawl 70 is generally perpendicular to both the longitudinal axes of the crank member 50 and the first panel, frame, or door 12. It is readily apparent from FIGS. 1–4 that the pawl pivots through approximately 90° as the pawl moves between unlatched and latched positions. With the latch assembly 10 in the unlatched position and the pawl 70 in the fully open or unlatched position, the pawl 70 will be out of the way of the second panel, frame, or door 16 so that one of the panels, frames, or doors 12, 16 can be opened relative to the other panel, frame, or door 12, 16.

Referring to FIGS. 25–48, the second embodiment of the latch assembly 210 comprises a housing 220, the crank member 250, a pawl 270, a crank pin 290, and a rivet 300. The latch assembly 210 may further comprise a means for actuating the crank member.

The housing 220, as illustrated in FIGS. 25–32, has spaced-apart side walls 222, 223, an open front end 224, a rear wall 226 extending between the side walls 222, 223, a top 228 having a cutout 229, and an open bottom 230. The cutout 229 provides clearance for the pawl 270 to unobstructively move between the unlatched and latched positions. Each side wall 222, 223, preferably substantially parallel and opposite to one another, has a first aperture 232, 233 located about the upper portion of the front end 224 and adapted for receiving the rivet 300, and a second aperture 236, 237 located about the lower portion of the front end 224 and adapted for receiving the means for actuating the crank member. It is preferred that the front end 224 is open so that a sufficient clearance is provided for the front end 276 of the pawl 270 to unobstructively move between the unlatched and latched positions. The rear wall 226 provides increased structural integrity to the housing 220. It is obvious to one in the art that any combination of the rear end 226 and bottom 230 of the housing 220, can be partially or completely closed. The lower edges 238, 239 of the side walls 222, 223 turn outwardly to form mounting flanges 240, 241 whereby each mounting flange 240, 241 has a mounting aperture 242, 243 for facilitating mounting of the housing 220 to the inside surface 14 of the first panel, frame, or door 12 by screws or any other fastening means (not shown) known in the art. It is obvious to one in the art that the mounting apertures 242, 243 and fastening means can be reversibly positioned on the first panel, frame, or door 12 and mounting flanges 240, 241, respectively, and that the mounting apertures 242, 243 and fastening means can be of any number and shape.

The crank member 250, as illustrated in FIGS. 33–36, has a pair of side walls 252, 253, and a cutout 254 positioned between the side walls 252, 253 for engaging with the pawl 270 and crank pin 290 during assembly. Each side wall 252, 253, preferably substantially parallel and opposite to one another, of the crank member 250 has a first aperture 264, 265 adapted for receiving the crank pin 290, and a second aperture 266, 267 adapted for receiving the means for actuating the crank member. The first aperture 264, 265 of each side wall 252, 253 serves as the pivot point for the pawl 270. It is preferred that the second apertures 266, 267 of the side walls 252, 253 of the crank member 250 are of hexagonal shape, but it is obvious to one in the art that the second apertures 266, 267 can be of any desired shaped.

The pawl 270, as illustrated in FIGS. 25–28 and 37–40, has an elongated body 272, a front end 276, a cutout 277 at the front end 276 for engaging with the crank member 250 during assembly, a rear end 278, a top 280, a bottom 282, a first aperture 284 located about the front, bottom portion of the pawl 270 and adapted for receiving the crank pin 290, and a slotted aperture 286 extending from about the middle portion of the pawl 270 toward the top portion of the pawl 270 and adapted for receiving the rivet 300. The slotted aperture 286 allows the pawl 270 to move and slide translationally when the means for actuating the crank member actuates and rotates the crank member 250. The catch 288 extends forwardly from the front end 276 at the top portion of the pawl 270, and helps to bring or grab the second panel, frame, or door 16 toward the first panel, frame, or door 12 when the pawl 270 is pivoted from the unlatched position to the latched position. The catch 288 gives the pawl 270 the appearance of having an L-shaped head. The pawl 270 is self-locking, or over center. A result of this self-locking and security feature is that the latch assembly 210 remains in the latched position when an additional force, such as the force generated by a person trying to pry the first and second panels, frames, or doors 12, 16 apart, is applied to the pawl 270 via the second panel, frame, or door 16. The latch assembly 210 cannot be placed in the unlatched position from the latched position without the crank member 250 being actuated by the means for actuating the crank member.

The crank pin 290 has a first end 292, a second end 294, and a longitudinal body 296 extending between the first and second ends 292, 294. The crank pin 290 is adapted for pivotally securing the pawl 270 to the crank member 250.

The rivet 300 has a head 302, a free end 304, and a longitudinal body 306 extending between the head 302 and free end 304. The rivet 300 is adapted for securing the pawl 270 with the housing 220 such that the head 302 is positioned proximate the first aperture 232, 233 of one of the side walls 222, 223, the free end 304 of the rivet 300 is positioned proximate the first aperture 232, 233 of the other side wall 222, 223, and the longitudinal body 306 of the rivet 300 is positioned generally perpendicular to the longitudinal axis of the pawl 270. It is preferred that the diameter of the head 302 is greater than the diameter of the corresponding first aperture 232, 233 of one of the side walls 222, 223 so that the head 302 will secure the pawl 270 with the housing 220 at one of the two ends. The pawl 270 and housing 220 can be secured to one another by any means known in the art, such as spreading the free end 304 of the rivet 300 in making the diameter of the spread free end 304 greater than the diameter of the corresponding first aperture 232, 233 of the other side wall 222, 223 so that the spread free end 304 will secure the pawl 270 with the housing 220 at the other end. Accordingly, the rivet 300 is supported by the housing 220 at a fixed location relative to the housing 220. The rivet 300 is also adapted for allowing the pawl 270 to move and slide upwardly and downwardly, and forwardly and rearwardly, via the slotted aperture 286 of the pawl 270 when the crank member 250 is actuated. In other words, the pawl 270 moves in a combination of translational and pivotal motions as the pawl 270 moves from the latched position to the unlatched position.

The means for actuating the crank member, such as a rod 110, is rotatably moveable about a longitudinal axis thereof. Some examples of the means for actuating the crank member are a rod 110, a knob member, a rod connected to an actuating system having a handle adapted for rotatably moving the rod 110, and any other actuating means known in the art. The means for actuating the crank member, such as a rod 110, is adapted for being positioned through the second apertures 236, 237 of the side walls 222, 223 of the housing 220 and the corresponding second apertures 266, 267 of the side walls 252, 253 of the crank member 250. Since the second apertures 236, 237 of the side walls 222, 223 of the housing 220 are preferably of hexagonal shape, it is preferred that the rod 110, knob member, and the like are also of hexagonal shape, but it is noted that the rod 110, knob member, and the like can be of any desired shape without departing from the spirit and scope of the present invention. From the description above it is readily apparent that the rod 110 engages the crank member 250 such that the crank member 250 rotates with the rod 110 about the longitudinal axis of the rod 110 as the rod 110 is rotated.

It is preferred that each of the housing 220, crank member 250, pawl 270, crank pin 290, and rivet 300 is made of one-piece construction and a material such as metal, metal alloy, or stainless steel.

Figure 27:
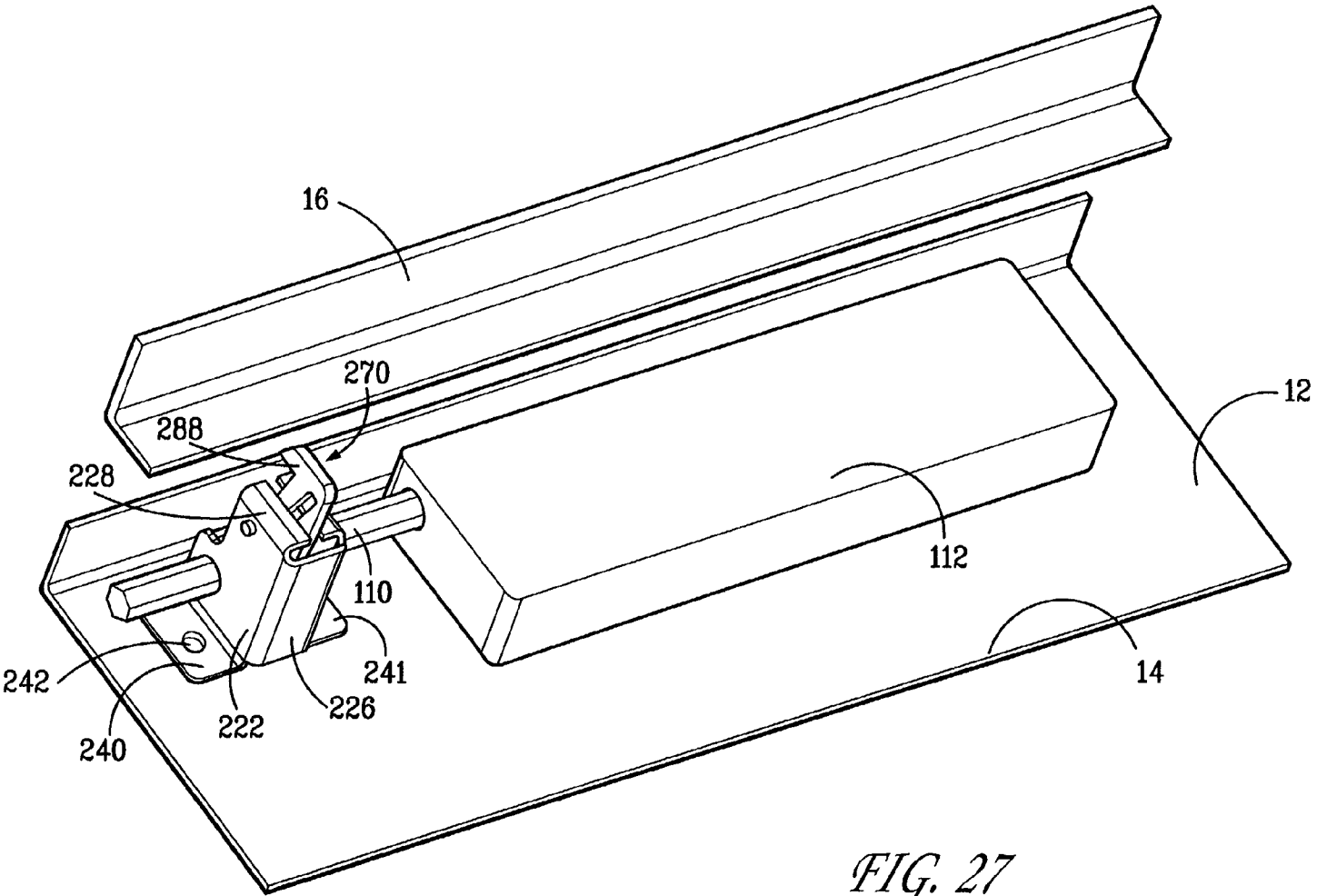
FIG. 27 is a rear environmental view of the latch assembly of FIG. 25, as applied to a first panel or the like, in the unlatched position.

When assembled, as illustrated in FIGS. 25–29, most of the elements or parts of the latch assembly 210 are positioned within or proximate the housing 220. In the assembled unlatched position as shown in FIG. 27, the crank pin 290 pivotally secures the pawl 270 to the crank member 250 such that the crank pin 290 are positioned within the first aperture of the pawl 270 and the corresponding apertures of the crank member 250. The pawl 270 is secured to the side walls 222, 223 of the housing 220 by the rivet 300 such that the rivet 300 passes through the slotted aperture 286 of the pawl 270 and the corresponding first apertures 232, 233 of the side walls 222, 223 of the housing 220. Further, the rod 110 is positioned through the second apertures 236, 237 of the side walls 222, 223 of the housing 220 and the corresponding second apertures 266, 267 of the side walls 252, 253 of the crank member 250. After assembly, the latch assembly 210 can be mounted to the inside surface 14 of the first panel, frame, or door 12 via the mounting apertures 242, 243 of the mounting flanges 240, 241 of the housing 220 by screws or any other fastening means (not shown) known in the art.

Figure 28:
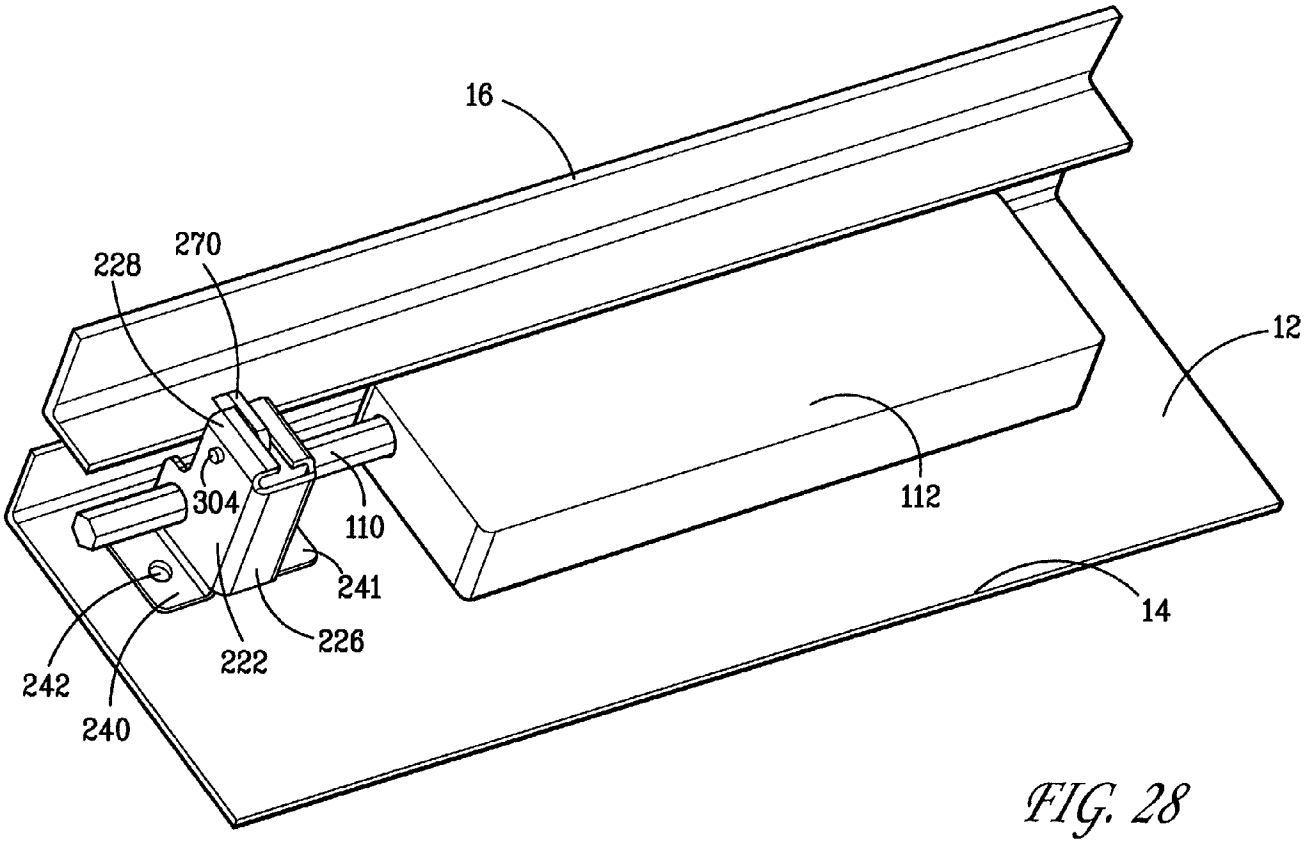
FIG. 28 is a rear environmental view of the latch assembly of FIG. 25, as applied to a first panel or the like, in the latched position.
Figure 30:
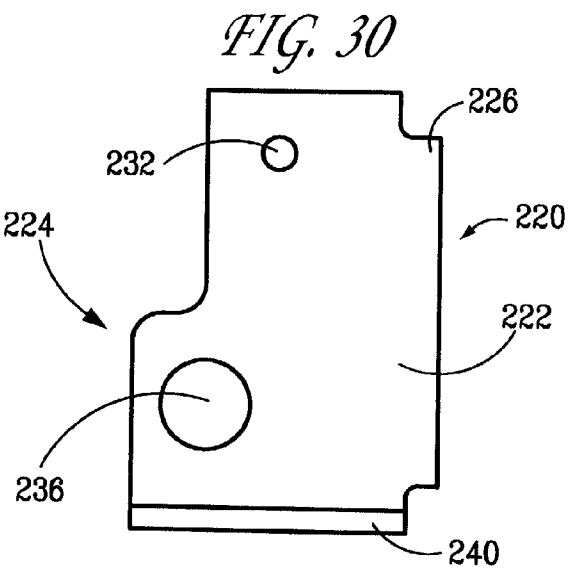
FIG. 30 is a side view of the housing of FIG. 29.
Figure 32:
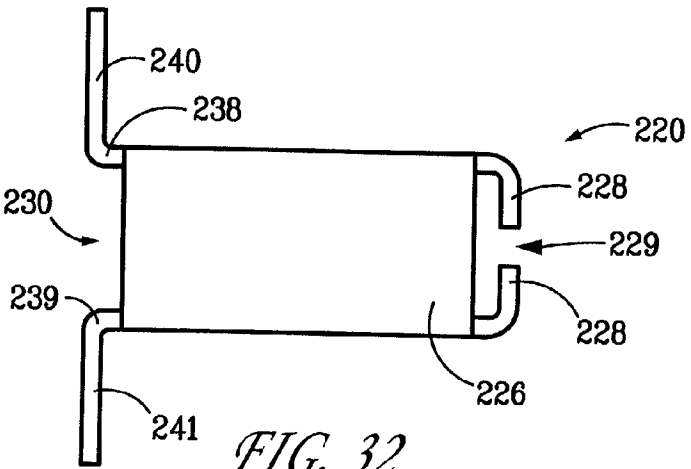
FIG. 32 is a rear view of the housing of FIG. 29.
Figure 29:
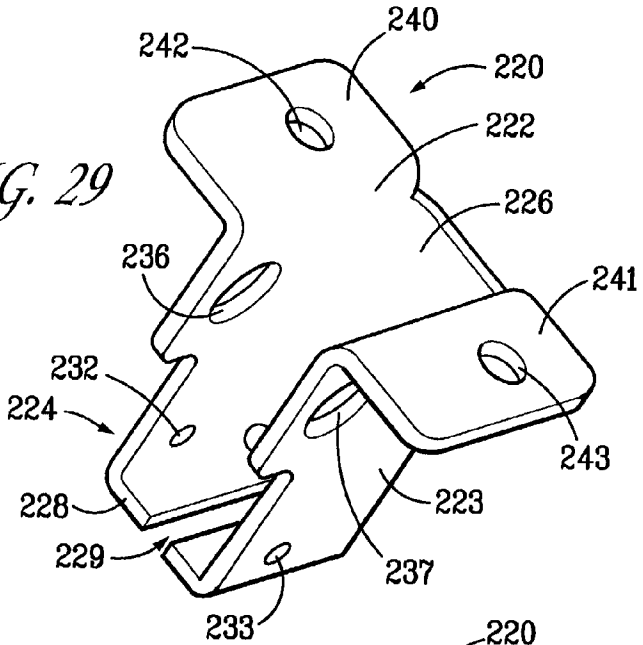
FIG. 29 is a front perspective view of a housing of the latch assembly of FIG. 25.
Figure 31:
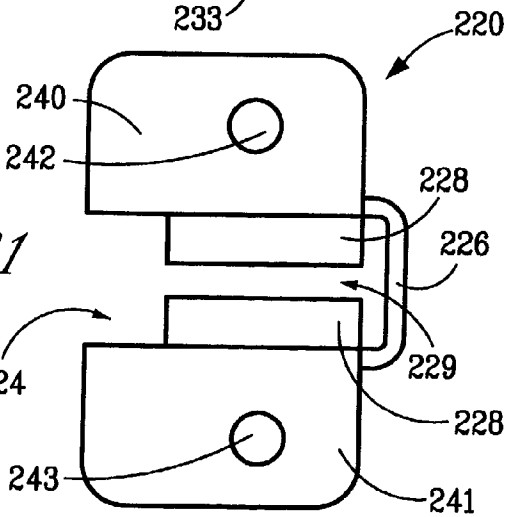
FIG. 31 is a bottom view of the housing of FIG. 29.
Figure 34:
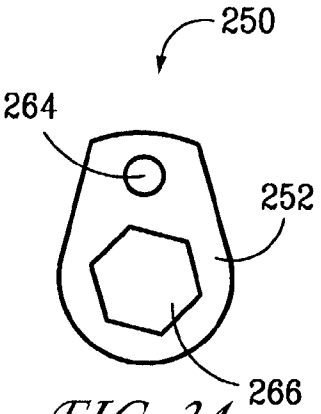
FIG. 34 is a side view of the crank member of FIG. 33.
Figure 36:
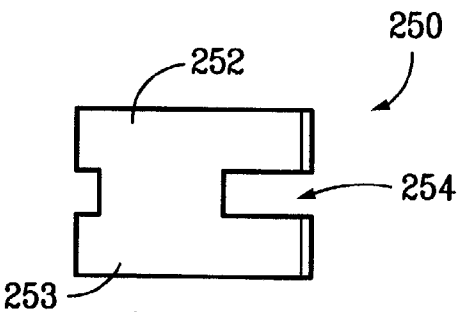
FIG. 36 is a rear view of the crank member of FIG. 33.
Figure 33:
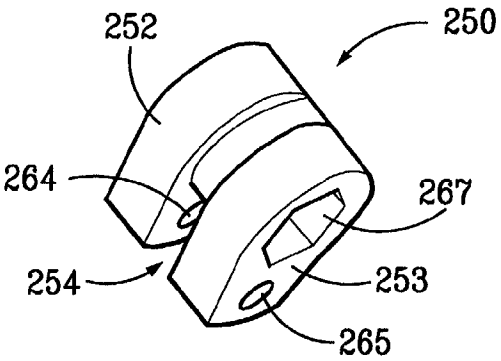
FIG. 33 is a top perspective view of a crank member of the latch assembly of FIG. 25.
Figure 35:
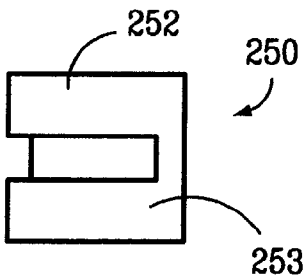
FIG. 35 is a bottom view of the crank member of FIG. 33.
Figure 38:
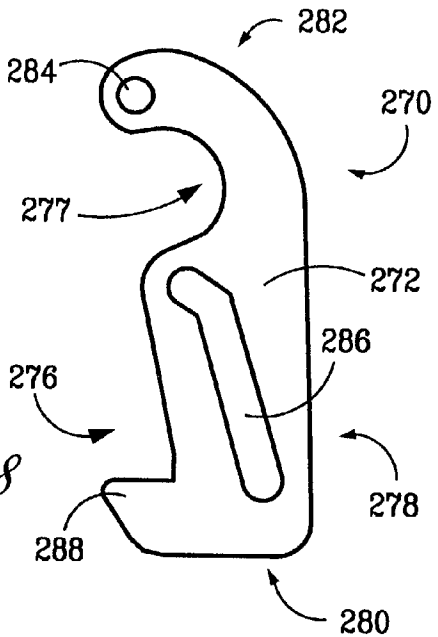
FIG. 38 is a side view of the pawl of FIG. 37.
Figure 40:
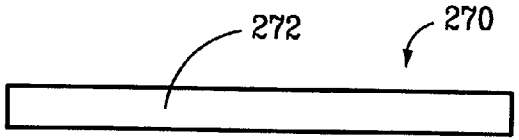
FIG. 40 is a rear view of the pawl of FIG. 37.
Figure 37:
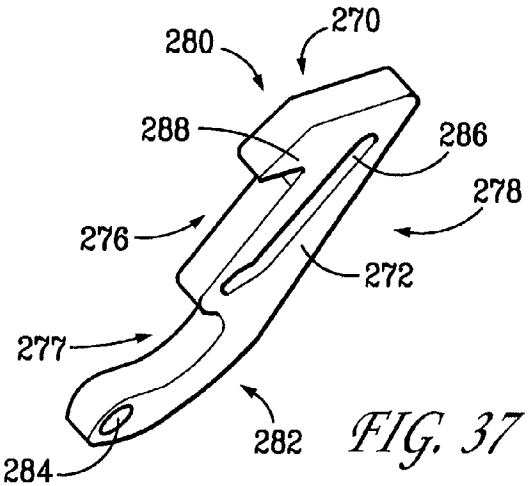
FIG. 37 is a perspective view of a pawl of the latch assembly of FIG. 25.
Figure 39:
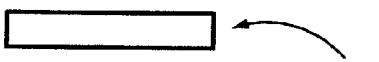
FIG. 39 is a bottom view of the pawl of FIG. 37.
Figure 41:
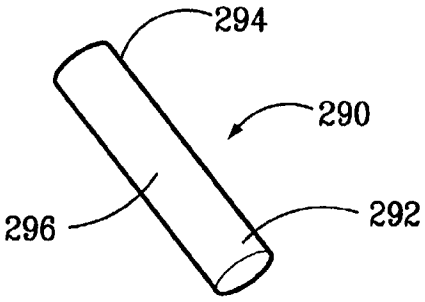
FIG. 41 is a perspective view of a crank pin of the latch assembly of FIG. 25.
Figure 42:
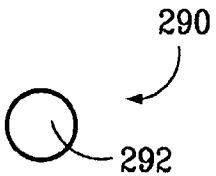
FIG. 42 is a side view of the crank pin of FIG. 41.
Figure 43:
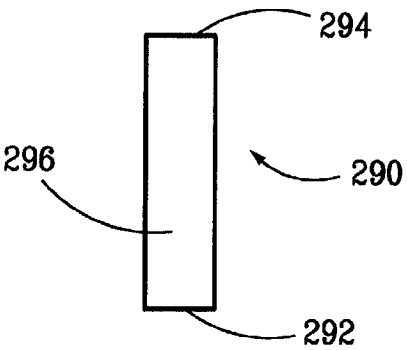
FIG. 43 is a front or rear view of the crank pin of FIG. 41.
Figure 44:
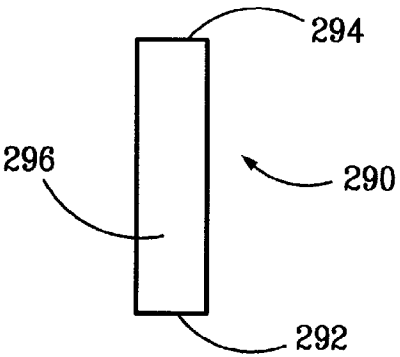
FIG. 44 is a top or bottom view of the crank pin of FIG. 41.
Figure 46:
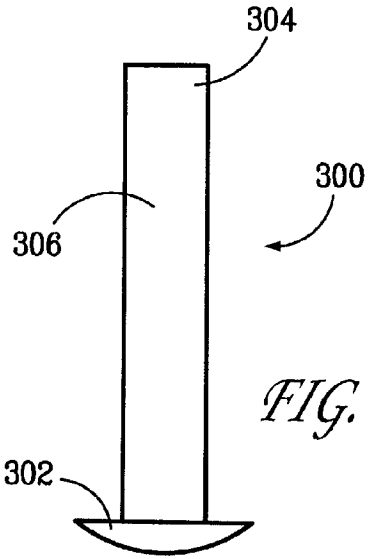
FIG. 46 is a right side view of the rivot of FIG. 45.
Figure 48:
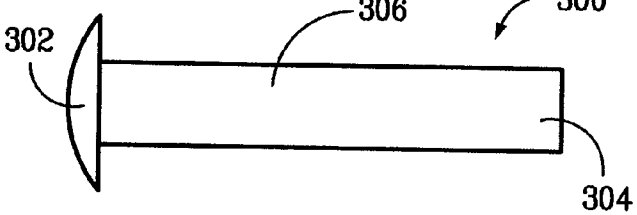
FIG. 48 is a left side view of the rivot of FIG. 45.
Figure 45:
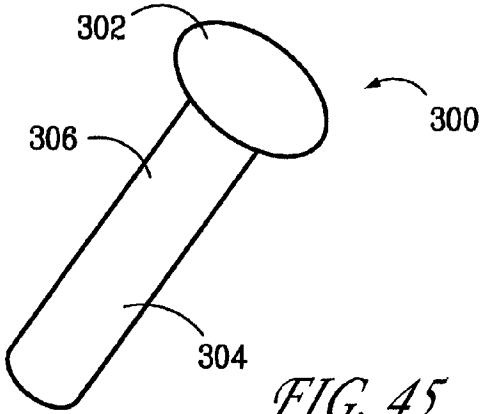
FIG. 45 is a perspective view of a rivot of the latch assembly of FIG. 25.
Figure 47:
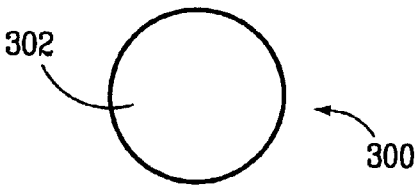
FIG. 47 is a top view of the rivot of FIG. 45.

In use, the assembled and mounted latch assembly 210 can be placed in the unlatched and latched positions by the means for actuating the crank member. To place the assembled and mounted latch assembly 210 in the unlatched position from the latched position (as shown in FIG. 28), the rod 110 is actuated to rotate in the direction toward the front end 224 and away from the rear end 226 of the housing 220 so that the crank member 250 is caused to rotate in the same general direction as the direction of rotation of the rod 110. The rotation of the crank member 250 then causes the pawl 270 to move and slide rearwardly and upwardly from the front end 224 and toward the rear wall 226 of the housing 220. From that point, the latch assembly 210 can then be placed in the fully unlatched position (as shown in FIG. 27) by continuing the rotation of the rod 110 till the most bottom portion of the slotted aperture 286 makes contact with the rivet 300. With the latch assembly 210 in the unlatched position and the pawl 270 in the fully open or unlatched position, the pawl 270 will be out of the way of the second panel, frame, or door 16 so that one of the panels, frames, or doors 12, 16 can be opened relative to the other panel, frame, or door 12, 16. It is readily apparent from FIGS. 25 and 26 that the crank member 250 pivots through an angle greater than 90° as the pawl 270 moves between unlatched and latched positions.

The above description and the views depicted in the FIGS. are for purposes of illustration only and are not intended to be, and should not be construed as, limitations on the invention. In particular and without limitation, terms such as front, rear, top, bottom, inside, etc. and derivatives thereof have been used for purposes of clarity in describing the invention only and it is to be understood that particular orientations will depend upon the use of the invention in a particular circumstance. Moreover, certain modifications or alternatives may suggest themselves to those skilled in the art upon reading of this specification, all of which are intended to be within the spirit and scope of the present invention as defined in the appended claims.

What is claimed is:

1. A latch assembly for securing a first panel relative to a second panel, the latch assembly comprising:

a housing adapted for attachment to the first panel;

a pawl pivotally attached to said housing, said pawl being movable between closed and open positions relative to said housing, said pawl being movable pivotally about a pivot axis defined by a pivot pin provided at a fixed location relative to said housing, said pawl having at least one longitudinal axis, wherein said pawl is approximately U-shaped in plan view so as to define a pair of pawl arms each having a slotted aperture;

a rod supported such that it can rotate about its own longitudinal axis with said longitudinal axis of said rod being substantially fixed in location relative to said housing, said pivot axis of said pawl being spaced apart from said longitudinal axis of said rod;

a crank member engaged to said rod so as to rotate therewith about said longitudinal axis of said rod, said crank member rotating between first and second positions responsive to rotation of said rod, said crank member having a longitudinal axis, said rod being adapted for providing means for actuating said crank member during operation of the latch assembly; and a crank pin attached to said crank member at a location spaced apart from said rod, said crank member fitting at least in part between said pawl arms and said crank pin engaging said slotted aperture in each of said pawl arms, said crank pin being positioned at least in part within said slotted aperture in each of said pawl arms and being engageable with said slotted aperture in each of said pawl arms and being movable relative to said slotted aperture in each of said pawl arms such that said crank pin can move and slide translationally within said slotted aperture in each of said pawl arms, wherein said pawl moves said open position to said closed position as said crank member pivotally moves from said first position to said second position, wherein said longitudinal axis of said pawl is generally perpendicular to said longitudinal axis of said crank member when said pawl is in said open position, and wherein said pawl pivots through approximately 90° as said pawl moves between said open and closed positions.

2. A latch assembly for securing a first panel relative to a second panel, the latch assembly comprising:

a housing adapted for attachment to the first panel;

a pawl being movable between closed and open positions relative to said housing, said pawl having at least one slotted aperture;

a rod supported such that it can rotate about its own longitudinal axis with said longitudinal axis of said rod being substantially fixed in location relative to said housing;

a crank member engaged to said rod so as to rotate therewith about said longitudinal axis of said rod, said crank member rotating between first and second positions responsive to rotation of said rod, said pawl being pivotally attached to said crank member, said rod being adapted for providing means for actuating said crank member during operation of the latch assembly; and a rivet supported by said housing at a fixed location relative to said housing, said fixed location of said rivet being spaced apart from said longitudinal axis of said rod, said rivet engaging said slotted aperture and guiding movement of said pawl between said open and closed positions, said rivet being movable relative to said slotted aperture along said slotted aperture, wherein said pawl moves from said open position to said closed position as said crank member pivotally moves from said first position to said second position, and wherein said slotted aperture has two portions that are angled relative to one another so as to guide said pawl in a combination of translation and pivotal motions as said pawl moves from said closed position to said open position.

3. The latch assembly according to claim 2, wherein said pawl has an L-shaped head adapted for engagement to the second panel or a keeper fixed to the second panel.

4. The latch assembly according to claim 2, wherein said crank member pivots through an angle greater than 90° as said pawl moves between said open and closed positions.

5. A latch assembly for securing a first panel relative to a second panel, the latch assembly comprising:

a housing adapted for attachment to the first panel;

a pawl pivotally attached to said housing, said pawl being pivotally movable between closed and open positions relative to said housing, said pawl being movable pivotally about a pivot axis fixed in location relative to said housing, said pawl having at least one slotted aperture, said slotted aperture having a rear portion;

a rod supported such that it can rotate about its own longitudinal axis with said longitudinal axis of said rod being substantially fixed in location relative to said housing, said pivot axis of said pawl being spaced apart from said longitudinal axis of said rod;

a crank member engaged to said rod so as to rotate therewith about said longitudinal axis of said rod, said crank member rotating between first and second positions responsive to rotation of said rod, said rod being adapted for providing means for actuating said crank member during operation of the latch assembly by being positioned through at least one aperture formed in a side wall of said housing such that said rod is engageable by an actuating system adapted for rotatably moving said rod; and a crank pin attached to said crank member at a location spaced apart from said rod, said crank pin being positioned at least in part within said slotted aperture and being engageable with said slotted aperture and being movable relative to said slotted aperture such that said crank pin can move and slide translationally within said slotted aperture, wherein said pawl moves from said open position to said closed position as said crank member pivotally moves from said first position to said second position and wherein said crank pin reaches said rear portion of said slotted aperture when said pawl is in said open position and said crank pin reaches said rear portion of said slotted aperture when said pawl is in said closed position.

6. The latch assembly according to claim 5, wherein said pawl is approximately U-shaped in plan view so as to define a pair of pawl arms each having a slotted aperture, said crank member fits at least in part between said pawl arms and said crank pin engages said slotted aperture in each of said pawl arms.

7. The latch assembly according to claim 5, wherein said pawl pivots through approximately 90° as said pawl moves between said open and closed positions.

8. A latch assembly for securing a first panel relative to a second panel, the latch assembly comprising:

a housing adapted for attachment to the first panel;

a pawl being movable between closed and open positions relative to said housing, said pawl having at least one slotted aperture;

a rod supported such that it can rotate about its own longitudinal axis with said longitudinal axis of said rod being substantially fixed in location relative to said housing;

a crank member engaged to said rod so as to rotate therewith about said longitudinal axis of said rod, said crank member rotating between first and second positions responsive to rotation of said rod, said pawl being pivotally attached to said crank member, said rod being adapted for providing means for actuating said crank member during operation of the latch assembly by being positioned through at least one aperture formed in a side wall of said housing such that said rod is engageable by an actuating system adapted for rotatably moving said rod; and a rivet supported by said housing at a fixed location relative to said housing, said fixed location of said rivet being spaced apart from said longitudinal axis of said rod, said rivet engaging said slotted aperture and guiding movement of said pawl between said open and closed positions, said rivet being movable relative to said slotted aperture along said slotted aperture, wherein said pawl moves from said open position to said closed position as said crank member pivotally moves from said first position to said second position.

9. The latch assembly according to claim 8, wherein said pawl has an L-shaped head adapted for engagement to the second panel or a keeper fixed to the second panel.

10. The latch assembly according to claim 8, wherein said slotted aperture has two portions that are angled relative to one another so as to guide said pawl in a combination of translational and pivotal motions as said pawl moves from said closed position to said open position.

11. The latch assembly according to claim 8, wherein said crank member pivots through an angle greater than 90° as said pawl moves between said open and closed positions.

12. A latch assembly for securing a first panel relative to a second panel, the latch assembly comprising:

a housing adapted for attachment to the first panel;

a pawl pivotally attached to said housing, said pawl being movable between closed and open positions relative to said housing, said pawl having at least one slotted aperture;

a rod supported such that it can rotate about its own longitudinal axis with said longitudinal axis of said operating rod being substantially fixed in location relative to said housing;

a crank member engaged to said operating rod so as to rotate therewith as a unit, said crank member rotating between first and second positions responsive to rotation of said rod; and a crank pin attached to said crank member at a location spaced apart from said operating rod, said pin engaging said slotted aperture and being movable relative to said slotted aperture along a longitudinal direction of said slotted aperture, wherein said pawl moves from said open position to said closed position as said actuating arm pivotally moves from said first position to said second position and wherein said at least one slotted aperture is one of a pair of slotted apertures, said pawl is approximately U-shaped in plan view so as to define a pair of pawl arms, each of said pair of pawl arms has a respective one of said pair of slotted apertures, said actuating arm fits at least in part between said pair of pawl arms and said crank pin engages said pair of slotted apertures in said pair of pawl arms.

* * * * *